US010638844B2

(12) United States Patent
Shih

(10) Patent No.: US 10,638,844 B2
(45) Date of Patent: May 5, 2020

(54) BASE SEAT FOR BED, CHAIR OR SOFA

(71) Applicants: RUOEY LUNG ENTERPRISE CORP., Lukang Township (TW); Lung-Tan Shih, Lukang Township (TW)

(72) Inventor: Lung-Tan Shih, Lukang Township (TW)

(73) Assignees: Ruoey Lung Enterprise Corp., Lukang Township (TW); Lung-Tan Shih, Lukang Township (TW)

( * ) Notice: Subject to any disclaimer, the term of this patent is extended or adjusted under 35 U.S.C. 154(b) by 39 days.

(21) Appl. No.: 16/200,094

(22) Filed: Nov. 26, 2018

(65) Prior Publication Data

US 2019/0246797 A1 Aug. 15, 2019

(30) Foreign Application Priority Data

Feb. 14, 2018 (TW) ..... 107105614 A

(51) Int. Cl.

| | |
|---|---|
| ***A47C 3/02*** | (2006.01) |
| ***A47C 3/18*** | (2006.01) |
| ***A47C 3/025*** | (2006.01) |

(52) U.S. Cl.

CPC ..... *A47C 3/0255* (2013.01); *A47C 3/0251* (2018.08); *A61H 2201/0142* (2013.01); *A61H 2201/0149* (2013.01)

(58) Field of Classification Search

CPC .... A47D 13/102; A47D 13/10; A47D 13/105; A47D 9/02; A47C 3/029; A47C 3/027; A47C 3/0255; A47C 3/02; A47C 3/025; A47C 3/0251

See application file for complete search history.

(56) References Cited

U.S. PATENT DOCUMENTS

| | | | | |
|---|---|---|---|---|
| 5,688,211 | A * | 11/1997 | Myers | A47D 13/107 297/5 |
| 7,717,798 | B2 * | 5/2010 | Bellows | A47D 13/10 472/36 |
| 9,265,349 | B1 * | 2/2016 | Jensen | A47C 3/18 |
| 2007/0120404 | A1 * | 5/2007 | Bellows | A47D 13/10 297/256.16 |
| 2015/0157951 | A1 * | 6/2015 | Lee | A63G 31/16 472/130 |
| 2017/0099949 | A1 * | 4/2017 | Fortier | A47C 3/0257 |
| 2019/0208911 | A1 * | 7/2019 | Zheng | A61H 9/0078 |
| 2019/0246797 | A1 * | 8/2019 | Shih | A47C 3/0251 |
| 2019/0298064 | A1 * | 10/2019 | Shih | A47C 3/0251 |

* cited by examiner

*Primary Examiner* — Shin H Kim

(74) *Attorney, Agent, or Firm* — Muncy, Geissler, Olds & Lowe, P.C.

(57) ABSTRACT

A base seat, which is adapted for being used with a bed, a chair or a sofa, includes a fixation base, a first rocking mount disposed above the fixation base and driven by a first drive device to reciprocatingly swing back and forth relative to the fixation base, a second rocking mount disposed above the first rocking mount and driven by a second drive device to reciprocatingly swing from side to side relative to the first rocking mount, and a swivel mount disposed above the second rocking mount and driven by a third drive device to rotate about an imaginary vertical axis. As such, the base seat can swing back and forth, swing from side to side, and rotate, independently or simultaneously.

12 Claims, 8 Drawing Sheets

BASE SEAT FOR BED, CHAIR OR SOFA

BACKGROUND OF THE INVENTION

1. Field of the Invention

The present invention relates generally to a furniture and more particularly, to a base seat adapted for being used with a bed, a chair or a sofa.

2. Description of the Related Art

Conventional swingable beds or rocking chairs are generally swingable back and forth or from side to side, i.e. in a single direction. Some types of chairs have a rotating function. After using the conventional rocking chairs or swingable beds having a monotone swinging or rotating direction for a certain period of time, users may feel boring or may not get a good relaxing feeling. However, developing a bed, chair or sofa that can swing back and forth, swing from side to side and/or rotate at the same time has to face many technical challenges. For example, multifunction usually leads to a complicated structure and a big number of components, resulting in that the volume of a base seat of the bed, chair or sofa unavoidably increases. In particular, the height of the base seat may be in excess of a normal height of the base seat of a conventional bed, chair or sofa. Further, the weight of the base seat will increase accordingly, causing difficulty in transportation, increase in manufacturing cost and adverse effect in sales in trade market. Moreover, when drive devices for driving the base seat to swing or rotate in various directions are running simultaneously, the accumulative noises generated by these drive devices are too loud, such that the user cannot relax.

SUMMARY OF THE INVENTION

The present invention has been accomplished in view of the above-noted circumstances. It is an objective of the present invention to provide a base seat for being used with a bed, chair or sofa, which can swing back and forth and from side to side and rotate independently or simultaneously and has a small overall height, such that the bed, chair or sofa equipped with the base seat could have a height fulfilled with a normal usage.

Another objective of the present invention is to provide a base seat for being used with a bed, chair or sofa, which has compact structure to facilitate transportation thereof, and has a low noise in operation and a low manufacturing cost.

To attain the above objectives, the present invention provides a base seat, which is adapted for being used with a bed, a chair or a sofa, comprising a fixation base, a first rocking mount, a second rocking mount, a swivel mount, a first drive device, a second drive device, and a third drive device. The first rocking mount is disposed above the fixation base in a way that the first rocking mount is reciprocatingly swingable forward and backward relative to the fixation base. The second rocking mount is disposed above the first rocking mount in a way that the second rocking mount is reciprocatingly swingable leftward and rightward relative to the first rocking mount. The swivel mount is disposed above the second rocking mount in a way that the swivel mount is rotatable about an imaginary vertical axis. The first drive device is disposed between the fixation base and the first rocking mount to drive the first rocking mount to reciprocatingly swing forward and backward relative to the fixation base. The second drive device is disposed between the first rocking mount and the second rocking mount to drive the second rocking mount to reciprocatingly swing leftward and rightward relative to the first rocking mount. The third drive device is disposed between the second rocking mount and the swivel mount to drive the swivel mount to rotate relative to the second rocking mount. As a result, the base seat can swing back and forth, swing from side to side, and rotate, independently or simultaneously, and has a compact structure to facilitate transportation thereof, a low noise in operation, and a low manufacturing cost.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
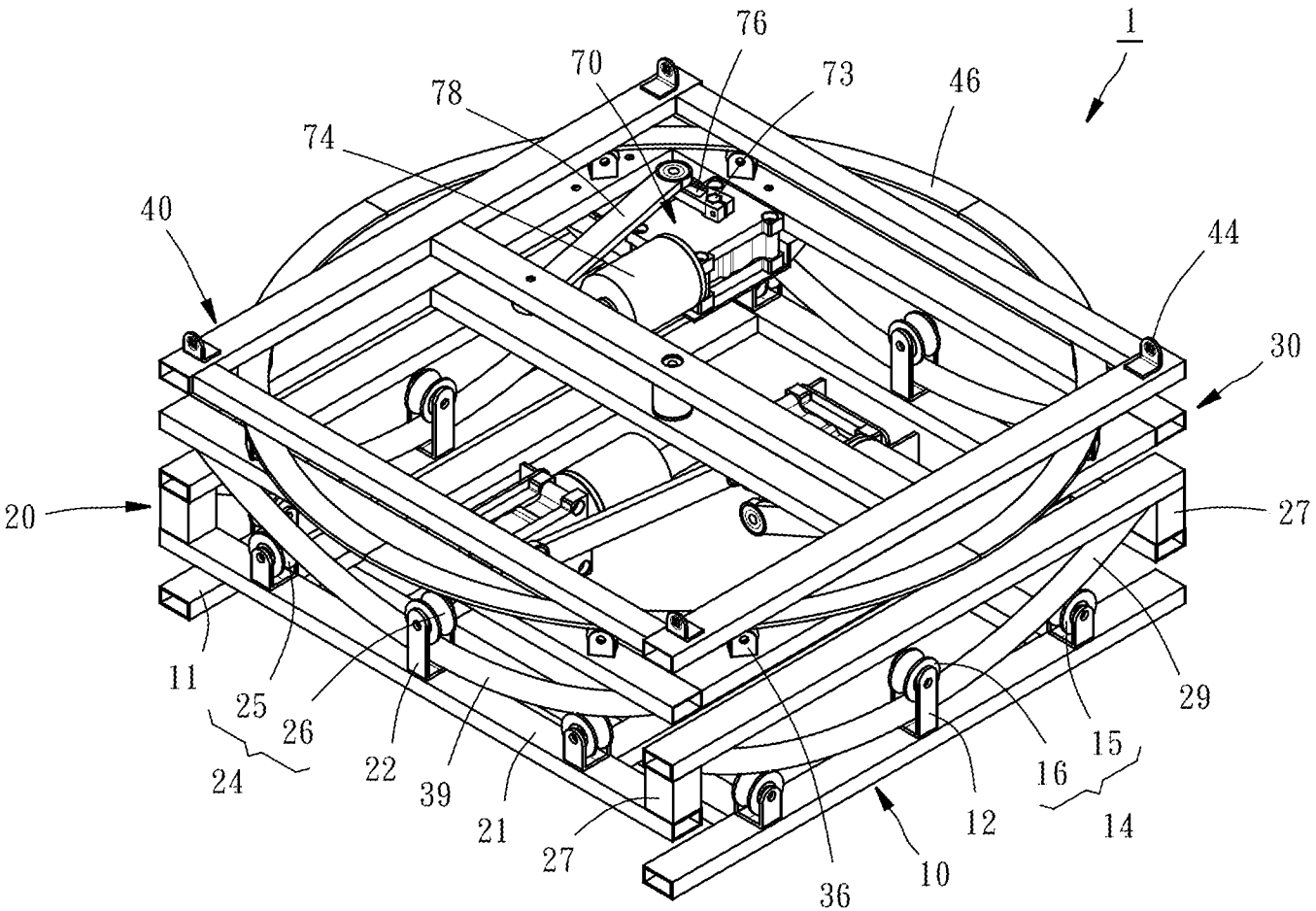
FIG. 1 is a perspective view of a base seat according to an embodiment of the present invention.
Figure 2:
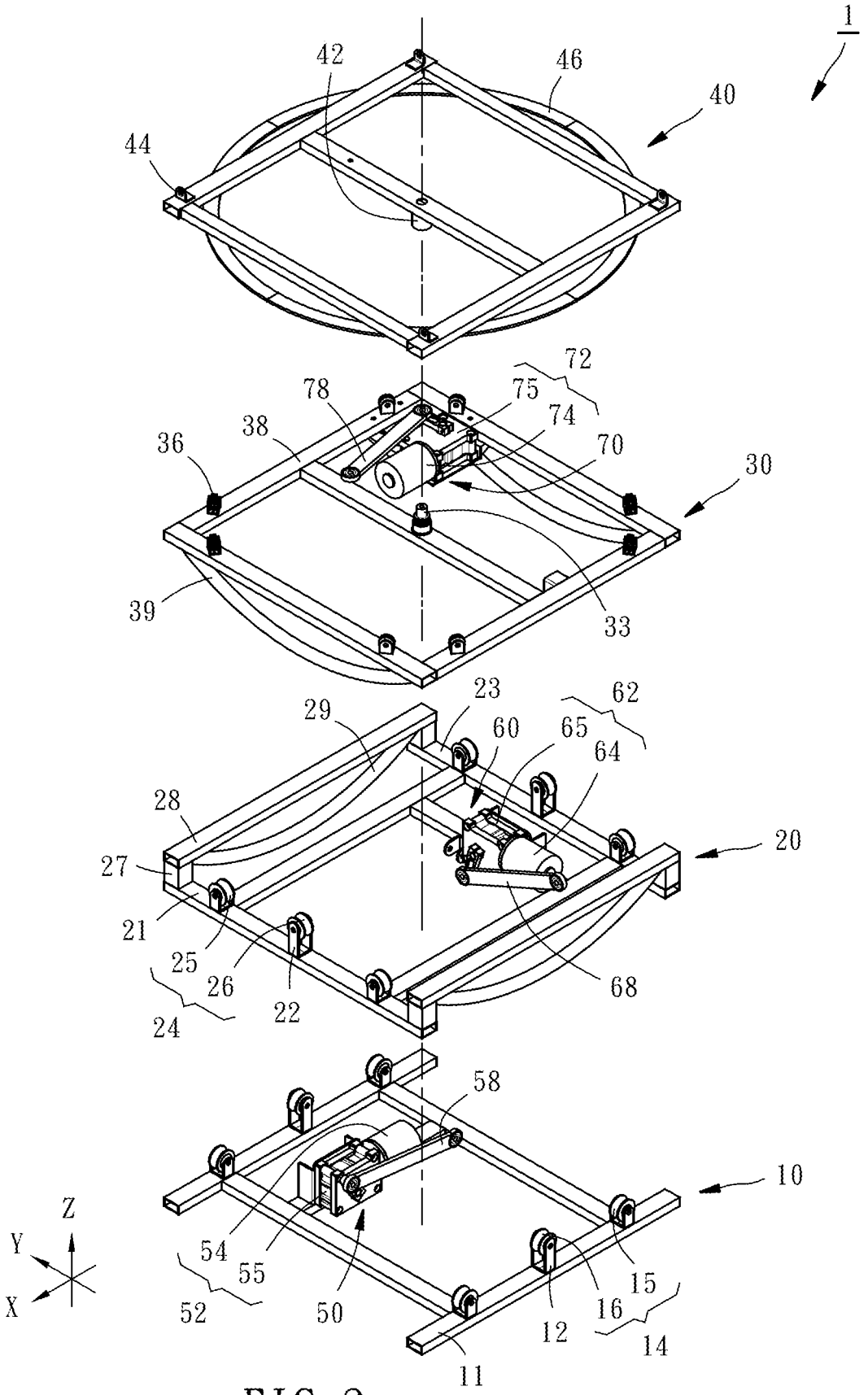
FIG. 2 is an exploded view of the base seat of the embodiment of the present invention.
Figure 3:
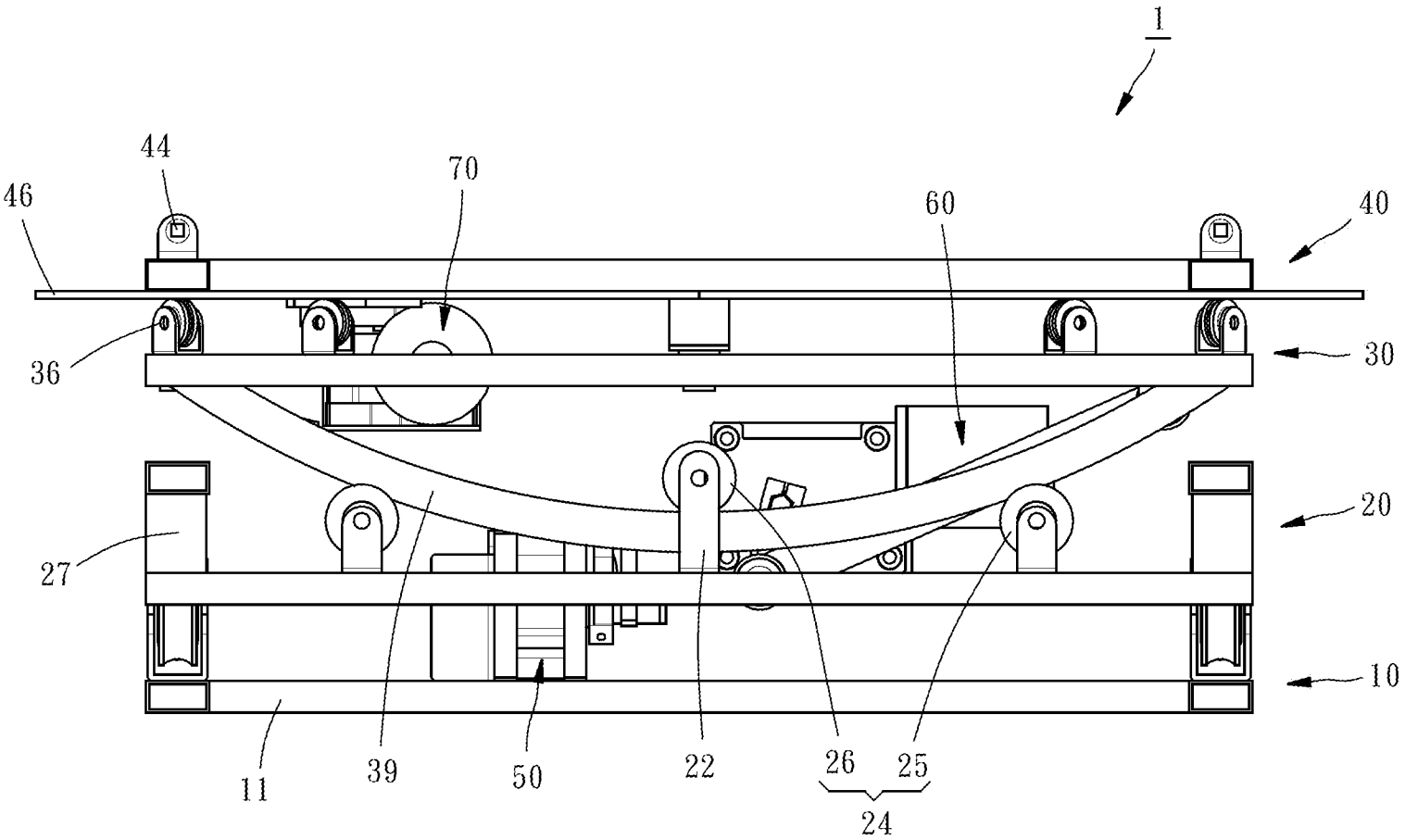
FIG. 3 is a front view of the base seat of the embodiment of the present invention.
Figure 4:
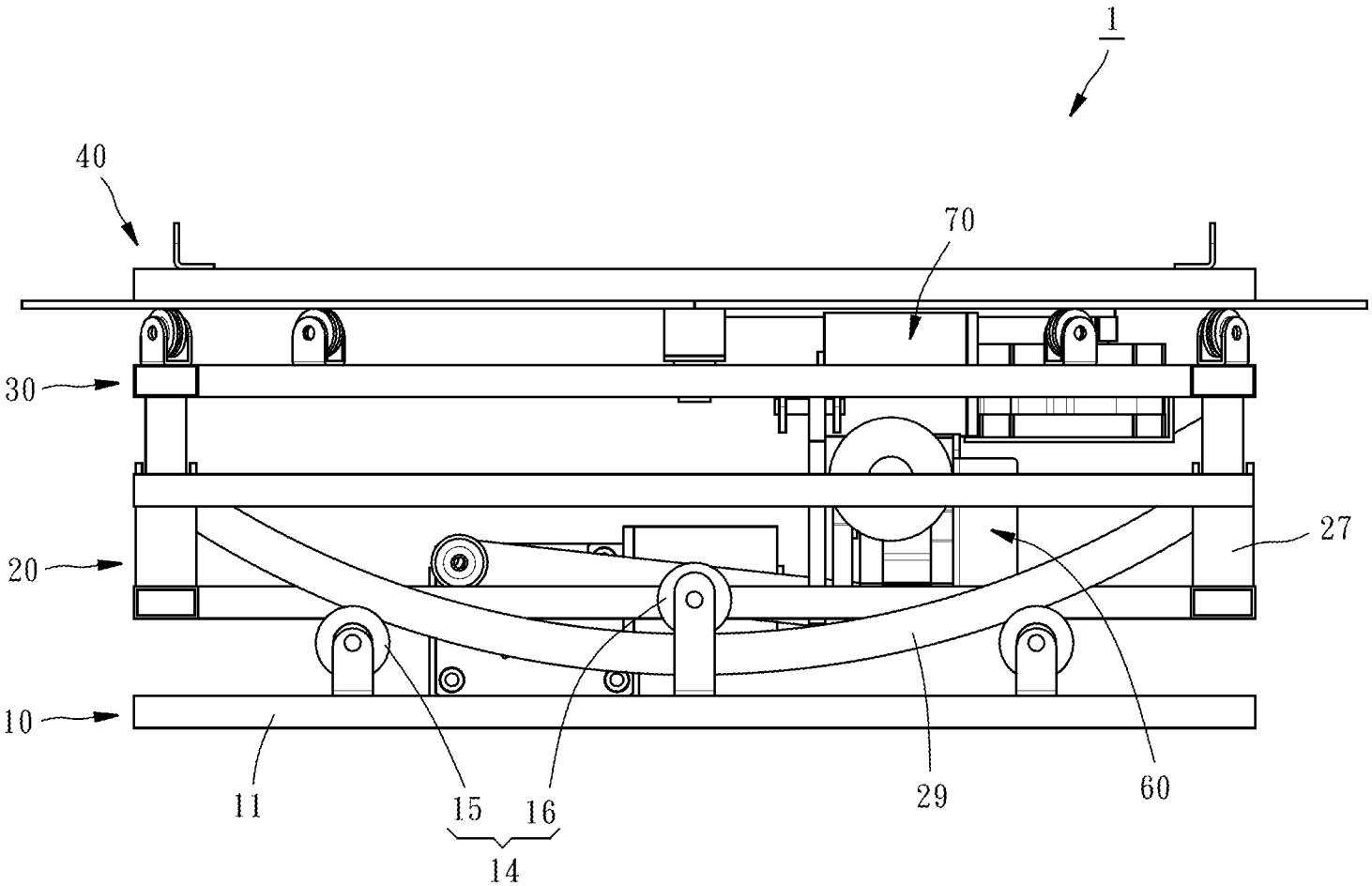
FIG. 4 is a lateral elevational view of the base seat of the embodiment of the present invention.
Figure 5:
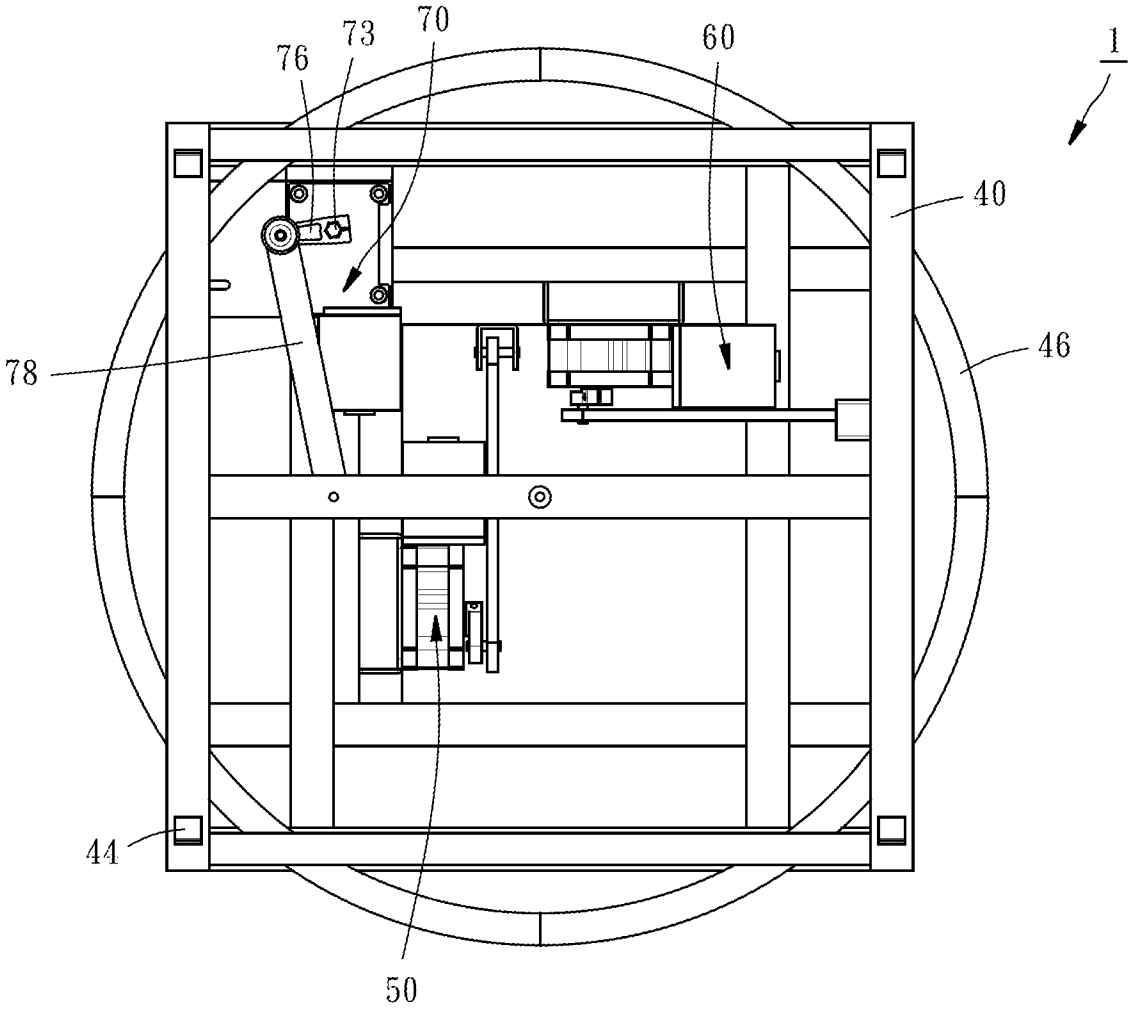
FIG. 5 is a top view of the base seat of the embodiment of the present invention.

The structure and technical features of the present invention will be detailedly described hereunder by a preferred embodiment and accompany drawings. FIGS. 1-5 show a base seat 1 for providing swinging and rotational motions in various directions for a bed (not shown), a chair (not shown) or a sofa (not shown) fixedly positioned thereon. The base seat 1 comprises a fixation base 10, a first rocking mount 20, a second rocking mount 30, a swivel mount 40, a first drive device 50, a second drive device 60, and a third drive device 70. To illustrate the relationships of various directions, the front and back direction described in the present invention is directed to the X-axis direction as shown in FIG. 2, the left and right direction is directed to the Y-axis direction, and the up and down direction is directed to the Z-axis direction. However, the directions themselves should not be treated as a limitation of the claim scope of the present invention.

The fixation base 10 includes a bottom portion 11 and six rollers 14 longitudinally arranged in two parallel rows. The bottom portion 11 is formed by a rectangular frame for being placed on a ground or a surface. Four supporting arms 12 extend upwardly from the bottom portion 11 and are arranged pair by pair. The longitudinally arranged rollers 14 are rotatably disposed above the bottom portion 11 and arranged in the front and back direction in two parallel rows each including two lower rollers 15 and one upper roller 16. Each upper roller 16 is rotatably disposed between paired two supporting arms 12 in a way that the upper roller 16 is located higher than the lower rollers 15 and the upper roller 16 is located between the two lower rollers 15 in a same row. In another embodiment, the shape of the bottom portion 11 and the number, arrangement and installation of the longitudinally arranged rollers 14 may be modified.

The first rocking mount 20 is disposed above the fixation base 10 and reciprocatingly swingable forward and backward, i.e. back and forth, relative to the fixation base 10. The first rocking mount 20 includes a front rack 21, a rear rack 23, a plurality of rollers 24 transversally arranged in two parallel rows, four posts 27, two lateral racks 28, and two longitudinally extending arc rails 29 extending in the front and back direction. Four supporting arms 22 extend upwardly and respectively from the front rack 21 and the rear rack 23 and are arranged pair by pair. The transversally arranged rollers 24 are rotatably and respectively disposed above the front rack 21 and the rear rack 23 and arranged in the left and right direction in two parallel rows each including two lower rollers 25 and one upper roller 26. Each upper roller 26 is rotatably disposed between paired two supporting arms 22 in a way that the upper roller 26 is located higher than the lower rollers 25 and the upper roller 26 is located between the two lower rollers 25 in a same row. The four posts 27 extend upwardly from two ends of the front rack 21 and two ends of the rear rack 23, respectively, and are connected with two ends of the two lateral racks 28, such that the front rack 21, the rear rack 23, the four posts 27 and the two lateral racks 28 combinedly form a complete frame. The two longitudinally extending arc rails 29 are respectively disposed below the two lateral racks 28, and each have two ends connected with two of the four posts 27. The longitudinally extending arc rails 29 are in contact with the longitudinally arranged rollers 14. The longitudinally extending arc rails 29 each have a shape of a sector of a circle and protrude downwardly. Each arc rail 29 extends through a space between one pared supporting arms 12 in a way that the longitudinally arranged rollers 14 are located above and below the longitudinally extending arc rails 29, respectively. The arc rail 29 is formed by a round tube such that the transverse cross-section of the arc rail 29 shows a circular profile, such that the arc rail 29 is linearly in contact with the longitudinally arranged rollers 14. As such, the first rocking mount 20 is reciprocatingly and inclinedly swingable forward and backward relative to the fixation base 10, i.e. swingable back and forth relative to the fixation base 10 like a pendulum having a pivot point suspended above the first rocking mount 20 that serves as a bob and a rod connected between the pivot point and the first rocking mount 20, thereby having stable structure and low friction with a reduced noise in operation. In another embodiment, the structure of the first rocking mount 20, the number, arrangement and installation of the transversally arranged rollers 24 may be modified. For example, the two lateral racks 28 may be omitted, and under this circumstance the four posts 27 may be configured extending downwardly from two ends of the two longitudinally extending arc rails 29, respectively, in a way that the front rack 21 is connected with bottoms of front two of the four posts 27, and the rear rack 23 is connected with bottoms of the rear two of the four posts 27.

The second rocking mount 30 is disposed above the first rocking mount 20 and reciprocatingly swingable leftward and rightward, i.e. from side to side, relative to the first rocking mount 20. The second rocking mount 30 includes a bearing portion 38, a pivot portion 33, eight sliding contact members 36, and two transversally extending arc rails 39 extending in the left and right direction. The bearing portion 38 is a square frame, and the pivot portion 33 is provided at the center of the bearing portion 38. The eight sliding contact members 36 are disposed on the bearing portion 38 in a way that the sliding contact members 36 are arranged around the pivot portion 33 in an imaginary circle having the pivot portion 33 as the center thereof. When the swivel mount 40 is assembled with the second rocking mount 30, the sliding contact members 36 are in contact with the swivel mount 40. The two transversally extending arc rails 39 are disposed below front and rear sides of the bearing portion 38 and extend downwardly and located between the two longitudinally extending arc rails 29 in a way that the two transversally extending arc rails 39 are in contact with the transversally arranged rollers 24. The arc rail 39 has a shape same as that of the arc rail 29. Each arc rail 39 extends through a space between one pared supporting arms 22 in a way that the transversally arranged rollers 24 are located above and below the transversally extending arc rails 39, respectively, such that the second rocking mount 30 can be stably coupled with the first rocking mount 20. As such, the second rocking mount 30 is reciprocatingly and inclinedly swingable leftward and rightward, i.e. from side to side, relative to the first rocking mount 20. In this embodiment, the sliding contact member 36 is realized as a roller. In another embodiment, the structure of the second rocking mount 30 may be modified. For example, the bearing portion 38 may be omitted, and under this circumstance two longitudinally extending racks may be used to connected with the two transversally extending arc rails 39, and the sliding members 36 may be disposed on the two transversally extending racks.

The swivel mount 40 is disposed above the second rocking mount 30 in a way that the swivel mount 40 is rotatable about an imaginary vertical axis passing through the fixation base 10, the first rocking mount 20, the pivot portion 33 of the second rocking mount 30 and a center of the swivel mount 40. In this embodiment, the swivel mount 40 is formed by a square frame and provided with a coupling portion 42, four connecting members 44 and an abutment portion 46. The coupling portion 42 is pivotally coupled with the pivot portion 33 of the second rocking mount 30. The four connecting members 44 are located on the top of the swivel mount 40 for being connected with the bed, chair or sofa. The abutment portion 46 is a circular ring-shaped member in contact with the sliding contact members 36, such that the swivel mount 40 can be smoothly rotated relative to the second rocking mount 30.

Figure 6:
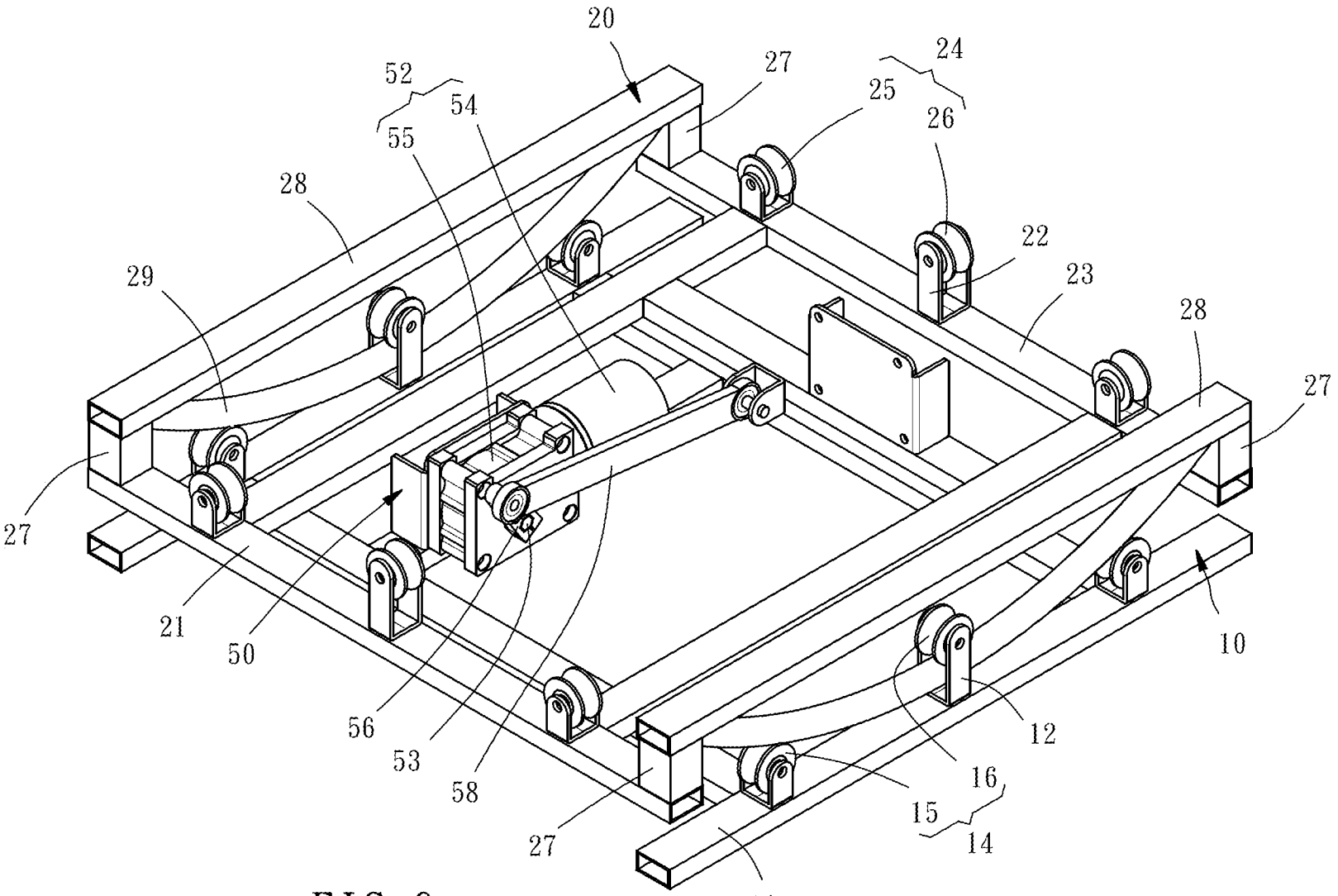
FIG. 6 is a perspective view showing an assembly of the fixation base, the first rocking mount and the first drive device of the base seat of the embodiment of the present invention.

FIG. 6 is a schematic view showing that the fixation base 10, the first rocking mount 20 and the first drive device 50 are assembled together. The first drive device 50 is disposed between the fixation base 10 and the first rocking mount 20 and capable of driving the first rocking mount 20 to reciprocatingly swing forward and backward relative to the fixation base 10. For the first drive device 50, various designs may be used. In this embodiment, the first drive device 50 comprises a first power source 52, a first crank 56 and a first link 58. The first power source 52 is disposed to the fixation base 10 and provided with a first output shaft 53. Specifically, the first power source 52 is composed of a first motor 54 and a first reduction gearbox 55. The first output shaft 53 extends horizontally in the Y-axis direction. The first crank 56 has an end connected with the first output shaft 53. Two ends of the first link 58 are pivotally connected with the first crank 56 and the first rocking mount 20. As such, when the first motor 54 is operated to drive the first output shaft 53 to rotate, the first rocking mount 20 is driven by the first link 58 through the first crank 56 to reciprocatingly and inclinedly swing back and forth relative to the fixation base 10.

Figure 7:
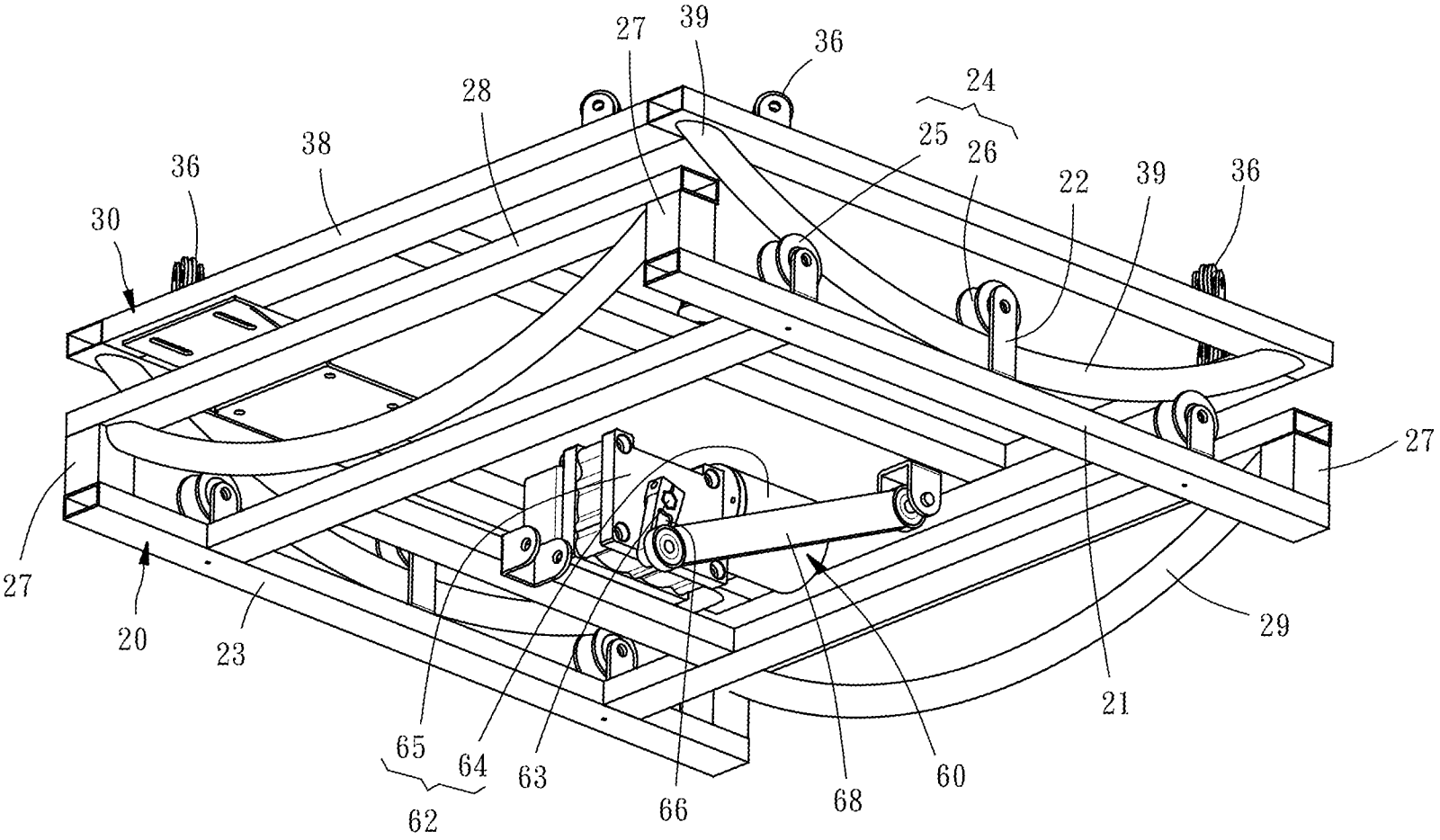
FIG. 7 is a perspective view showing an assembly of the first rocking mount, the second rocking mount, and the second drive device of the base seat of the embodiment of the present invention.

FIG. 7 is a schematic view showing that the first rocking mount 20, the second rocking mount 30 and the second drive device 60 are assembled together. The second drive device 60 has a structure same as that of the first drive device 50. The second drive device 60 is disposed between the first rocking mount 20 and the second rocking mount 30 and capable of driving the second rocking mount 30 to reciprocatingly swing from side to side relative to the first rocking mount 20. The second drive device 60 comprises a second power source 62, a second crank 66 and a second link 68. The second power source 62 is disposed to the first rocking mount 20 and provided with a second output shaft 63. Specifically, the second power source 62 is composed of a second motor 64 and a second reduction gearbox 65. The second output shaft 63 extends horizontally in the X-axis direction. The second crank 66 has an end connected with the second output shaft 63. Two ends of the second link 68 are pivotally connected with the second crank 66 and the second rocking mount 30. As such, when the second motor 64 is operated to drive the second output shaft 63 to rotate, the second rocking mount 30 is driven by the second link 68 through the second crank 66 to reciprocatingly and inclinedly swing from side to side relative to the first rocking mount 20.

Figure 8:
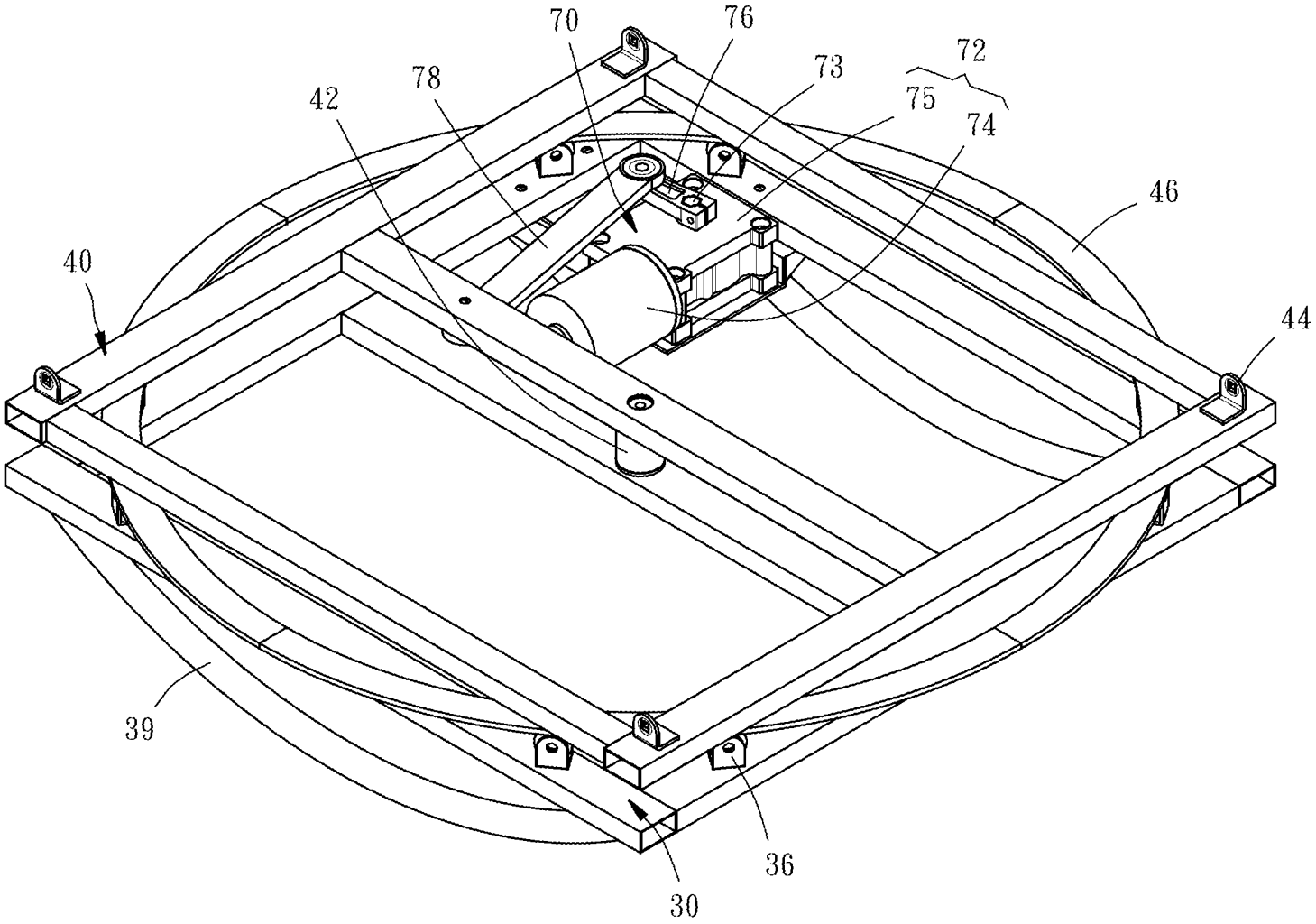
FIG. 8 is a perspective view showing an assembly of the second rocking mount, the swivel mount, and the third drive device of the base seat of the embodiment of the present invention.

FIG. 8 is a schematic view showing that the second rocking mount 30, the swivel mount 40 and the third drive device 70 are assembled together. The third drive device 70 has a structure same as that of the first and second drive devices 50 and 60. The third drive device 70 is disposed between the second rocking mount 30 and the swivel mount 40 and capable of driving the swivel mount 40 to rotate relative to the second rocking mount 30. The third drive device 70 comprises a third power source 72, a third crank 76 and a third link 78. The third power source 72 is disposed to the second rocking mount 30 and provided with a third output shaft 73. Specifically, the third power source 72 is composed of a third motor 74 and a third reduction gearbox 75. The third crank 76 has an end connected with the third output shaft 73. The third output shaft 73 extends vertically in the Z-axis direction. Two ends of the third link 78 are pivotally connected with the third crank 76 and the swivel mount 40. As such, when the third motor 74 is operated to drive the third output shaft 73 to rotate, the swivel mount 40 is driven by the third link 78 through the third crank 76 to reciprocatingly rotate relative to the second rocking mount 30.

In another embodiment, the structure of the swivel mount 40 may be modified. For example, the swivel mount 40 may be formed by a circular disc, such that the bottom surface of the circular disc serves as the abutment portion 44 directly. Further, it is only required that the two ends of the first drive device 50 are pivotally and respectively connected with the fixation base 10 and the first rocking mount 20, the two ends of the second drive device 60 are pivotally and respectively connected with the first rocking mount 20 and the second rocking mount 30, and the two ends of the third drive device 70 are pivotally and respectively connected with the second rocking mount 30 and the swivel mount 40. In other words, the pivotally connecting locations and types of the drive devices are not limited to the disclosure of this embodiment.

With the above-mentioned structural design, when a bed, chair or sofa is installed on the base seat 1 of the present invention, and more specifically when the bed, chair or the sofa is fixedly mounted on the swivel mount 40, the base seat 1 can be operated to drive the bed, chair or the sofa to swing back and forth, swing from side to side and/or rotate. The base seat 1 of the present invention has advantages of compact and stable structure and small volume to facilitate transportation thereof, thereby providing a more comfortable and relaxing usage experience to the user. In particular, the two transversally extending arc rails 39 extend downwardly into a space between the two longitudinally extending arc rails 29, such that the overall height of the base seat 1 is only about 30 cm. With this structural feature, when the base seat 1 of the present invention is mounted to a bed, chair or sofa, the height of the bed, chair or sofa is about a normal height that users get used to it. Further, the three drive devices 50, 60, and 70 are same types, which are cost effective in manufacturing and assembly. Such kind of drive device has low vibration and noise in operation, lowering the adverse effect to the users to make users feel comfortable and relaxing so as to achieve the objectives of the present invention.

Based on the technical features of the present invention, various modifications to the structure of the base seat 1 of the present invention may be made. For example, the installation locations of the sliding contact members 36 and the abutment portion 46 can be exchanged, i.e. the sliding contact members 36 are provided at the bottom of the swivel mount 40 and the abutment portion 46 is provided at the top of the second rocking mount 30. Further, the sliding contact member 36 can be realized by an engineering plastic block, a ball rotary mount, a ring bearing, or a universal ball, and one or more sliding contact members can be used in the base seat 1, i.e. at least one sliding contact member is sufficient. A ring-shaped ball rotary mount may be disposed between the swivel mount and the second rocking mount, and under this circumstance the pivot portion and the coupling portion may be omitted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A base seat for being used with a bed, a chair, or a sofa, the base seat comprising:

a fixation base;

a first rocking mount disposed above the fixation base in a way that the first rocking mount is reciprocatingly swingable forward and backward relative to the fixation base;

a second rocking mount disposed above the first rocking mount in a way that the second rocking mount is reciprocatingly swingable leftward and rightward relative to the first rocking mount;

a swivel mount disposed above the second rocking mount in a way that the swivel mount is rotatable about an imaginary vertical axis;

a first drive device disposed between the fixation base and the first rocking mount to drive the first rocking mount to reciprocatingly swing forward and backward relative to the fixation base;

a second drive device disposed between the first rocking mount and the second rocking mount to drive the second rocking mount to reciprocatingly swing leftward and rightward relative to the first rocking mount; and a third drive device disposed between the second rocking mount and the swivel mount to drive the swivel mount to rotate relative to the second rocking mount.

2. The base seat of claim 1, wherein the fixation base is provided with a plurality of longitudinally arranged rollers arranged in two parallel rows; the first rocking mount is provided with two longitudinally extending arc rails in contact with the longitudinally arranged rollers.

3. The base seat of claim 2, wherein the first rocking mount is provided with a plurality of transversally arranged rollers arranged in two parallel rows; the second rocking mount is provided with two transversally extending arc rails in contact with the transversally arranged rollers.

4. The base seat of claim 3, wherein the first rocking mount further comprises four posts extending downwardly from two ends of the two longitudinally extending arc rails respectively, a front rack connected with bottoms of two of the four posts, and a rear rack connected with bottoms of the other two of the four posts; the transversally arranged rollers are respectively disposed on the front rack and the rear rack in a way that the two transversally extending arc rails extend downward and located between the two longitudinally extending arc rails.

5. The base seat of claim 1, comprising at least one sliding contact member disposed between the second rocking mount and the swivel mount.

6. The base seat of claim 5, wherein the sliding contact member is a roller, an engineering plastic block, a ball rotary mount or a universal ball.

7. The base seat of claim 5, wherein the second rocking mount comprises a pivot portion, and the swivel mount comprises a coupling portion coupled with the pivot portion of the second rocking mount.

8. The base seat of claim 2, wherein the longitudinally arranged rollers are located above and below the longitudinally extending arc rails, respectively.

9. The base seat of claim 3, wherein the transversally arranged rollers are located above and below the transversally extending arc rails, respectively.

10. The base seat of claim 1, wherein the first drive device comprises a first power source, a first crank, and a first link; the first power source is disposed to the fixation base and provided with a first output shaft extending horizontally; the first crank has an end connected with the first output shaft; the first link has two ends pivotally connected with the first crank and the first rocking mount.

11. The base seat of claim 1, wherein the second drive device comprises a second power source, a second crank, and a second link; the second power source is disposed to the first rocking mount and provided with a second output shaft extending horizontally; the second crank has an end connected with the second output shaft; the second link has two ends pivotally connected with the second crank and the second rocking mount.

12. The base seat of claim 1, wherein the third drive device comprises a third power source, a third crank, and a third link; the third power source is disposed to the second rocking mount and provided with a third output shaft extending vertically; the third crank has an end connected with the third output shaft; the third link has two ends pivotally connected with the third crank and the swivel mount.

* * * * *